US006936962B2

(12) United States Patent
Hamada et al.

(10) Patent No.: US 6,936,962 B2
(45) Date of Patent: Aug. 30, 2005

(54) LIGHT-EMITTING DEVICE HAVING A PLURALITY OF EMISSION LAYERS

(75) Inventors: Yuji Hamada, Nara (JP); Hiroshi Kanno, Osaka (JP); Kazuki Nishimura, Hirakata (JP)

(73) Assignee: Sanyo Electric Co., Ltd., Osaka (JP)

( * ) Notice: Subject to any disclaimer, the term of this patent is extended or adjusted under 35 U.S.C. 154(b) by 45 days.

(21) Appl. No.: 10/670,203

(22) Filed: Sep. 26, 2003

(65) Prior Publication Data

US 2004/0066139 A1 Apr. 8, 2004

(30) Foreign Application Priority Data

Sep. 30, 2002 (JP) ..... 2002-287425
May 22, 2003 (JP) ..... 2003-144278

(51) Int. Cl.[7] ..... H01J 1/62
(52) U.S. Cl. ..... 313/506; 313/498; 313/503
(58) Field of Search ..... 313/498, 502, 313/503, 504, 506, 512

(56) References Cited

FOREIGN PATENT DOCUMENTS

JP 2000-164362 A 6/2000
JP 3287344 3/2002
JP 2002-108285 4/2002
JP 2002-216971 A 8/2002

OTHER PUBLICATIONS

Reference No. NPA 1030048, Dispatch No. 149482, Dispatch Date Apr. 22, 2005, Patent Application No. 2003–144278, Drafting Date Apr. 20, 2005, Examiner of JPO: Toshimitsu Satomura 9314 2V00, Title of Invention: Light Emitting Device, Applicant:Sanyo Electric Co., Ltd.

*Primary Examiner*—Vip Patel
(74) *Attorney, Agent, or Firm*—McDermott Will & Emery LLP

(57) ABSTRACT

A light-emitting device including a plurality of emission layers, which has improved luminous efficiency and improved reliability (or device lifetime), is provided. The light-emitting device includes a first emission layer formed on a substrate, and a second emission layer formed on the first emission layer to provide a laminated structure, for emitting light having a different wavelength from that of light emitted by the first emission layer. At least one of the first emission layer and the second emission layer includes a host material, a luminescent first dopant material and a non-luminescent second dopant material.

20 Claims, 6 Drawing Sheets

Alq3

CuPC

ORANGE EMISSION LAYER (HOST)

LIGHT-EMITTING DEVICE HAVING A PLURALITY OF EMISSION LAYERS

BACKGROUND OF THE INVENTION

1. Field of the Invention

The present invention relates to a light-emitting device, and, more particularly, to a light-emitting device having a plurality of emission layers.

2. Description of the Background Art

In recent years, displays using organic electroluminescent devices (hereinafter referred to as "organic EL devices") as flat-panel display devices have been developed to find applications in a wide variety of information equipment. The organic EL devices are expected to provide flat-panel displays that consume less power than CRTs conventionally and generally used in the art, and are also expected to provide nonpolluting (i.e., mercury-free) illumination devices, which will replace fluorescent lamps, and the like.

In the organic EL device, electrons and holes are injected from an electron injecting electrode and a hole injecting electrode, respectively, into an emission layer, so that the electrons and the holes are recombined in the emission layer so as to bring organic molecules into the excited state. The organic EL device then emits fluorescent light when the excited organic molecules return to the ground state. As known in the art, the organic EL device has a multi-layer structure including layers formed of, for example, a material capable of transporting electrons, a material capable of transporting holes, and a luminescent material, so as to provide an improved luminous efficiency.

In recent years, an organic EL device including a plurality of emission layers adapted to emit different wavelengths of light has been proposed in, for example, Japanese Patent No. 3287344. The organic EL device disclosed in this patent includes a first emission layer formed by doping a host material with a first fluorescent material (or dopant material) that emits orange light, and a second emission layer formed by doping a host material with a second fluorescent material (or dopant material) that emits blue light. The orange light and blue light emitted by the respective emission layers are mixed together to produce a white emission.

Recently, an improvement of the luminous efficiency of the organic EL device has been desired to make the device suitable for practical use. In the case where white light is changed or converted through color filters so as to produce full-color emissions, in particular, the luminous efficiency needs to be further improved in view of an optical loss caused by the color filters.

In the organic EL device disclosed in the above-mentioned Japanese Patent No. 3287344, however, each of the first emission layer that produces an orange emission and the second emission layer that produces a blue emission contains a luminescent dopant (i.e., a fluorescent material) as a single dopant, and it is thus difficult to enhance the luminous efficiency to an even higher level. If the organic EL device has a low luminous efficiency, a large amount of current is required to pass through the device, and the device may degrade earlier than expected, resulting in a reduction in the reliability (or lifetime) of the device. Thus, when it is difficult to improve the luminous efficiency, it is also difficult to improve the reliability (or device lifetime).

SUMMARY OF THE INVENTION

It is an object of the present invention to provide a light-emitting device including a plurality of emission layers, which exhibits improved luminous efficiency and improved reliability (or device lifetime).

In order to accomplish the above object, the inventors found, as a result of intensive studies, that the luminous efficiency can be improved by providing an emission layer that contains a host material, a luminescent first dopant material, and a non-luminescent second dopant material.

More specifically, a light-emitting device according to one aspect of the invention includes a first emission layer formed on a substrate, and a second emission layer formed on the first emission layer to provide a laminated structure, for emitting light having a different wavelength from that of light emitted by the first emission layer. In this light-emitting device, at least one of the first emission layer and the second emission layer contains a host material, a luminescent first dopant material, and a non-luminescent second dopant material.

In the light-emitting device according to the above-indicated one aspect of the invention in which at least one of the first and second emission layers contains the host material, luminescent first dopant material and the non-luminescent second dopant material, if the non-luminescent second dopant material has the function of supporting the luminescent property of the device, e.g., the function of assisting in transportation of carriers and the function of transferring energy from the host material to the luminescent first dopant material, the probability of recombination of the carriers can be enhanced due to the function of assisting in transportation of the carriers, and the energy can be efficiently transferred from the host material to the luminescent first dopant due to the function of transferring energy from the host material to the luminescent first dopant. As a result, the luminous efficiency can be improved. The improvement in the luminous efficiency eliminates a need to feed a large amount of current to the device, and therefore otherwise possible deterioration of the device can be suppressed. Consequently, the reliability of the device (or the device lifetime) can be improved (or prolonged).

In the light-emitting device according to the above-indicated one aspect of the invention, the non-luminescent second dopant material preferably has at least one of the function of assisting in transportation of carriers and the function of transferring energy from the host material to the luminescent first dopant material. With this arrangement, the probability of recombination of the carriers can be enhanced due to the function of assisting in transportation of the carriers, and the energy can be efficiently transferred from the host material to the luminescent first dopant material due to the function of transferring energy from the host material to the luminescent first dopant material.

In this case, the non-luminescent second dopant material preferably contains a naphthacene derivative having the function of transferring energy from the host material to the luminescent first dopant material. Thus, the second dopant material having the function of transferring energy from the host material to the luminescent first dopant material can be easily obtained. The second dopant material consisting of the naphtacene derivative may be tBuDPN. In this case, the second dopant material consisting of the tBuDPN is preferably contained in at least one of the first emission layer and the second emission layer in an amount that is equal to or greater than 5% by weight and is less than 50% by weight. This is because, if the content of tBuDPN is less than 5% by weight, the function of transferring energy from the host material to the luminescent first dopant material cannot be sufficiently performed.

In another example, the non-luminescent second dopant material may contain a rubrene derivative having the function of transferring energy from the host material to the luminescent first dopant material. In this case, too, the second dopant material having the function of transferring energy from the host material to the luminescent first dopant material can be easily obtained.

Also, the non-luminescent second dopant material preferably contains an amine derivative having the function of assisting in transportation of the carriers. Thus, the second dopant material having the function of assisting in transportation of the carriers can be easily obtained. The non-luminescent second dopant material consisting of amine derivative may be NPB. In this case, the second dopant material consisting of NPB is preferably contained in at least one of the first emission layer and the second emission layer in an amount that is equal to or greater than 5% by weight and is less than 50% by weight. This is because, if the content of NPB is less than 5% by weight, the function of assisting in transportation of the carriers cannot be sufficiently performed.

In the light-emitting device according to the above-indicated one aspect of the invention, each of the first emission layer and the second emission layer preferably contains the host material, the luminescent first dopant material, and the non-luminescent second dopant material. With this arrangement, the luminous efficiencies of both of the first and second emission layers can be improved, and therefore the light-emitting device as a whole exhibits a further improved luminous efficiency, resulting in further improved reliability (or device lifetime).

In the light-emitting device according to the above-indicated one aspect of the invention, the first emission layer preferably includes an orange emission layer containing the second dopant material having the function of transferring energy from the host material to the luminescent first dopant material, and the second emission layer preferably includes a blue emission layer containing the second dopant material having the function of assisting in transportation of carriers. With this arrangement, the orange emission layer and the blue emission layer cooperate with each other to produce a white emission, with an improved luminous efficiency due to the functions of the second dopant materials contained in the orange emission layer and the blue emission layer. Thus, the light-emitting device capable of emitting white light exhibits improved reliability (and prolonged device lifetime).

In this case, the orange emission layer may contain an amine derivative as the host material, a naphthacene derivative as the luminescent first dopant material, and a naphthacene derivative as the non-luminescent second dopant material having the function of transferring energy from the host material to the luminescent first dopant material. In this case, the orange emission layer preferably contains NPB as the host material, DBzR as the luminescent first dopant material, and tBuDPN as the second dopant material. Thus, the orange emission layer having the function of transferring energy from the host material to the luminescent first dopant material can be easily obtained.

Also, the blue emission layer may contain an anthracene derivative as the host material, a perylene derivative as the luminescent first dopant material, and an amine derivative as the non-luminescent second dopant material having the function of assisting in transportation of the carriers. In this case, the blue emission layer preferably contains TBADN as the host material, TBP as the luminescent first dopant material, and NPB as the non-luminescent second dopant material. Thus, blue emission layer having the function of assisting in transportation of the carriers can be easily obtained.

In the light-emitting device according to the above-indicated one aspect of the invention, the first emission layer preferably includes an orange emission layer disposed on the side of a light-emitting surface of the light-emitting device, and the second emission layer preferably includes a blue emission layer disposed on the side opposite to the light-emitting surface. With this arrangement, the orange emission layer is formed on a hole transport layer, and therefore a problem that would occur if the blue emission layer is formed on the hole transport layer can be eliminated. Namely, if the blue emission layer is formed on the hole transport layer comprised of NPB having a small electron mobility, electrons are accumulated on the lower surface of the blue emission layer, and further injection of electrons into the blue emission layer is hampered or impeded. On the other hand, the light-emitting device constructed as described above will not suffer from this problem.

Preferably, the light-emitting device according to the above-indicated one aspect of the invention further includes a thin-film transistor formed on the substrate for each pixel, and a color filter disposed above a region in which the thin-film transistor is not formed and disposed below the first emission layer and the second emission layer. The thus constructed light-emitting device will provide an active drive type full-color display that exhibits improved luminous efficiency and improved reliability (or device lifetime).

In the light-emitting device according to the above-indicated one aspect of the invention, the first emission layer preferably includes an orange emission layer containing the second dopant material having the function of transferring energy from the host material to the luminescent first dopant material. With this arrangement, the energy can be efficiently transferred from the host material to the luminescent first dopant material due to the function of the second dopant material, i.e., the function of transferring energy from the host material to the luminescent first dopant material. Thus, the luminous efficiency of the orange emission layer can be easily improved.

In the light-emitting device according to the above-indicated one aspect of the invention, the second emission layer preferably includes a blue emission layer containing the second dopant material having the function of assisting in transportation of carriers. With this arrangement, the probability of recombination of the carriers can be enhanced due to the function of the second dopant material, i.e., the function of assisting in transportation of the carriers. Thus, the luminous efficiency of the blue emission layer can be easily improved.

In the light-emitting device according to the above-indicated one aspect of the invention, the non-luminescent second dopant material includes at least two second dopants, and the two or more second dopants include a dopant that assists in transportation of carriers, and a dopant that transfers energy from the host material to the luminescent first dopant material. With this arrangement, the probability of recombination of the carriers can be enhanced due to the function of assisting in transportation of the carriers, and the energy can be efficiently transferred from the host material to the luminescent first dopant material due to the function of transferring energy from the host material to the luminescent first dopant material. Thus, the luminous efficiency of the light-emitting device can be further improved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Some embodiments of the present invention will be described with reference to the drawings.

FIRST EMBODIMENT

Figure 1:
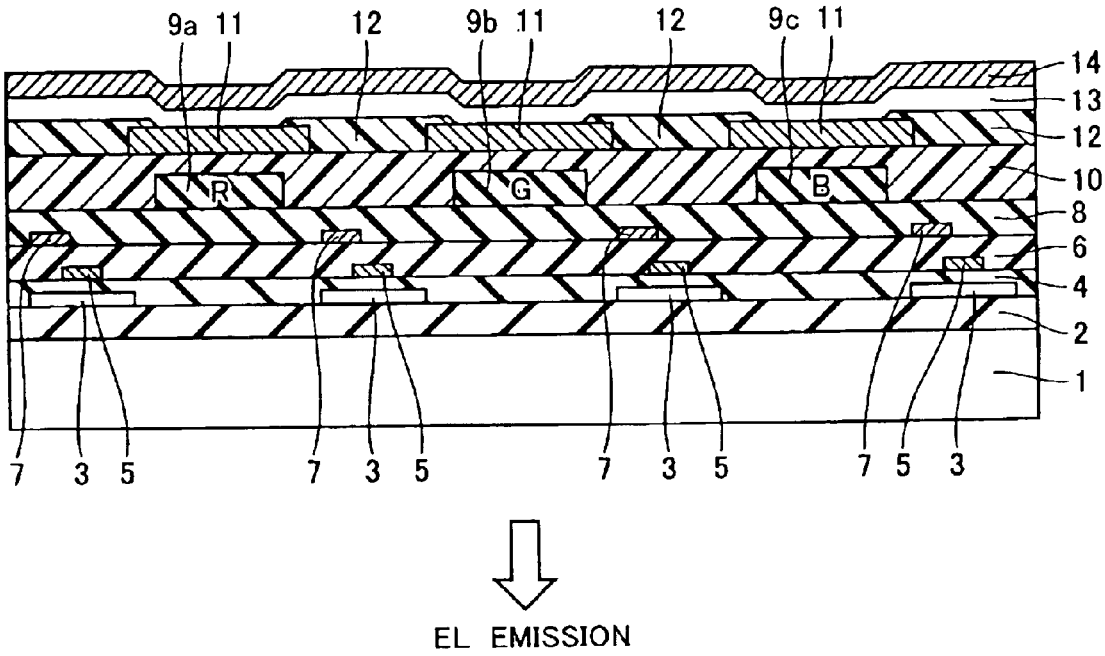
FIG. 1 is a cross-sectional view showing an active drive type full-color organic EL device according to a first embodiment of the present invention.
Figure 2:
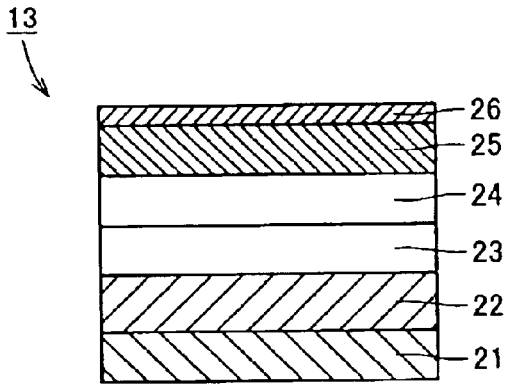
FIG. 2 is a cross-sectional view showing the construction of an organic layer of the organic EL device according to the first embodiment shown in FIG. 1.

Referring to FIG. 1 and FIG. 2, the structure of an organic EL device constructed according to a first embodiment of the invention will be described. The organic EL device of the first embodiment includes a glass substrate 1, and a protective layer 2 formed on the glass substrate 1. The protective layer 2 has a laminated structure consisting of a $N_x$ film and a $SiO_2$ film, and has a film thickness of about 130 nm. The glass substrate 1 is an example of the "substrate" of the present invention. Polysilicon films 3 shaped like islands are formed on the protective film 2 at predetermined spacings. A gate insulating film 4 having a laminated structure of a $SiO_2$ film and a $SiN_x$ film and having a thickness of about 100 nm is formed over the polysilicon films 3 and the protective film 2. In addition, gate electrodes 5 are formed on local regions of the gate insulating film 4 which are located above the polysilicon films 3. The polysilicon films 3, gate insulating film 4 and the gate electrodes 5 cooperate to form thin-film transistors (TFT). The TFTs are provided for respective pixels.

Furthermore, an inter-layer insulating film 6 having a laminated structure of a $SiN_x$ film and a $SiO_2$ film and having a thickness of about 500 nm is formed over the gate electrodes 5 and the gate insulating film 4. Signal lines 7 are formed on the inter-layer insulating film 6 at predetermined spacings. Another inter-layer insulating film 8 consisting of a $SiN_x$ film and having a thickness of about 300 nm is formed over the signal lines 7 and the inter-layer insulating film 6. In addition, a red filter 9*a* having a thickness of about 1600 nm, a green filter 9*b* having a thickness of about 1650 nm, and a blue filter 9*c* having a thickness of about 1700 nm are formed on the inter-layer insulating film 8 at predetermined spacings. The red filter 9*a*, green filter 9*b* and the blue filter 9*c* are formed on local regions of the inter-layer insulating film 8 which are not located above the TFTs. (Namely, the filters 9*a*, 9*b* and 9*c* do not overlap the TFTs as viewed in the direction of the thickness of the organic EL device.) The red filter 9*a*, green filter 9*b* and the blue filter 9*c* constitute a color filter.

A leveling film 10 consisting of a resist and having a thickness of about 1100 nm is formed over the red filter 9*a*, green filter 9*b* and the blue filter 9*c*. Transparent anodes 11 each consisting of an ITO (Indium Tin Oxide) film and having a thickness of about 85 nm are formed on the leveling film 10 at predetermined spacings. The transparent anodes 11 provide respective pixel electrodes. A pixel separation structure 12 consisting of a resist and having a thickness of about 100 nm is formed to cover the upper faces of the leveling film 10 located between the adjacent transparent anodes 11 and end portions of the transparent anodes 11.

An organic layer 13 is formed over the transparent anodes 11 and the pixel separation structure 12. A cathode (common electrode) 14 formed of aluminum (Al) is formed on the organic layer 13.

As shown in FIG. 2, the organic layer 13 includes a hole injecting layer 21, a hole transport layer 22 formed on the hole injecting layer 21, an orange emission layer 23 formed on the hole transport layer 22, a blue emission layer 24 formed on the orange emission layer 23, an electron transport layer 25 formed on the blue emission layer 24, and an electron injecting layer 26 formed on the electron transport layer 25. The hole injecting layer 21 has a laminated structure of an about 10 nm-thickness CuPC film formed in contact with the transparent anodes 11 (shown in FIG. 1), and an about 1 nm-thickness $CF_x$ film (fluorocarbon polymer film) formed on the CuPC film. The hole transport layer 22 is formed of NPB and has a thickness of about 140 nm.

Figure 3:
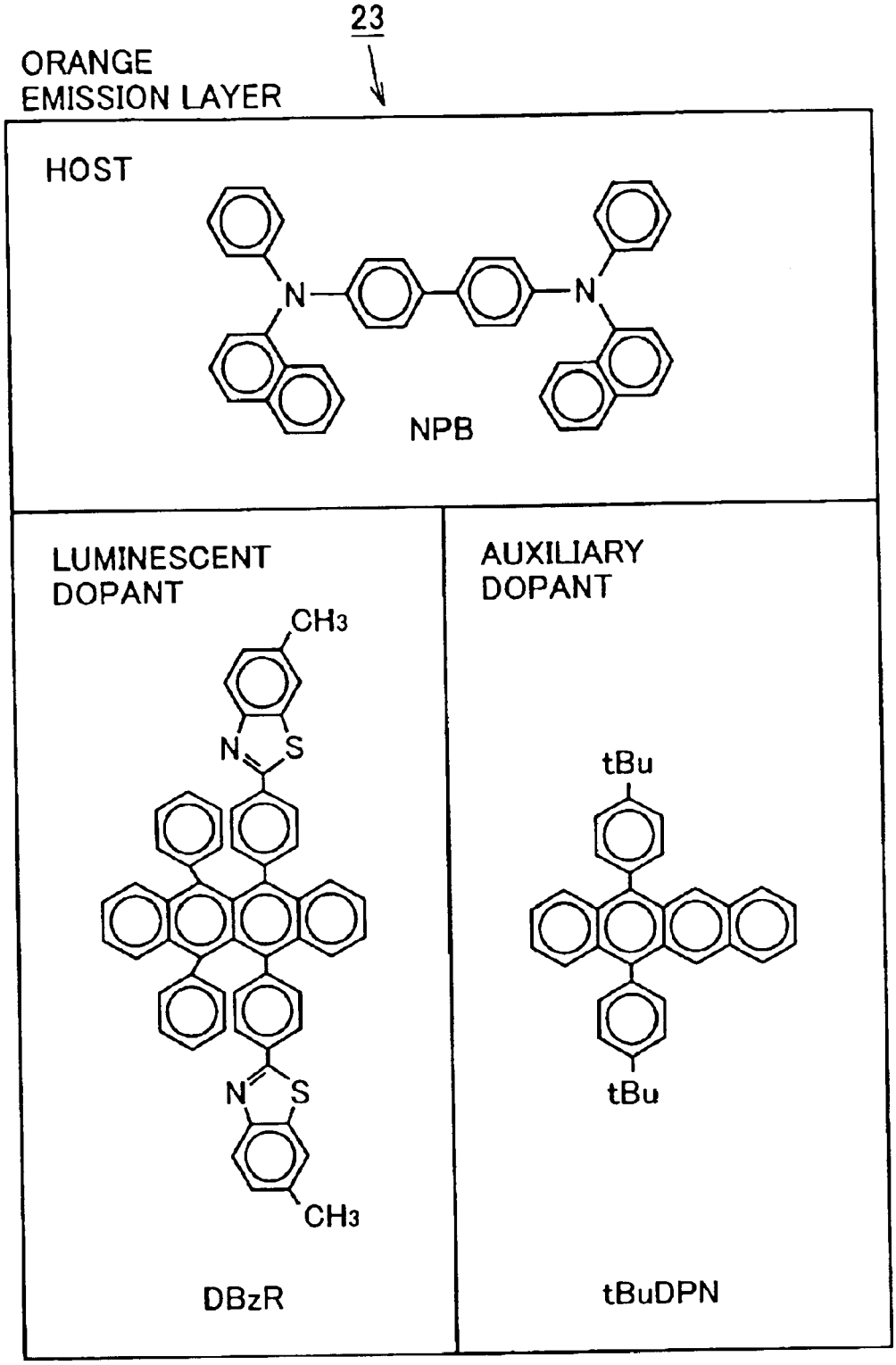
FIG. 3 is a view showing the molecular structures of a host material, a luminescent dopant and an auxiliary dopant, which are contained in an orange emission layer of the organic EL device according to the first embodiment shown in FIG. 2.

In the first embodiment, the orange emission layer 23 includes a host material which is NPB (N,N'-Di (naphthalene-1-yl)-N,N'-diphenyl benzidine), a luminescent dopant which is DBzR (5,12-Bis(4-(6-methylbenzothiazol-2-yl)phenyl)-6,11-diphenylnaphthacene), and a non-luminescent auxiliary dopant (i.e., an auxiliary dopant that does not emit light) which is tBuDPN (5,12-Bis(4-tert-butylphenyl)naphthacene), as shown in FIG. 3. The orange emission layer 23 preferably contains about 0.1 wt % to about 20 wt % of DBzR as the luminescent dopant. If the content of DBzR is less than about 0.1 wt %, effective luminescence cannot be produced. If the content of DBzR exceeds about 20 wt %, the luminous intensity is reduced due to concentration quenching. In the first embodiment, therefore, the content of DBzR is set to about 3 wt %. The DBzR as the luminescent dopant is a naphthacene derivative, and has the function of emitting orange light. Thus, the orange emission layer 23, which contains DBzR as the luminescent dopant, emits light having a wavelength of about 550 nm to about 650 nm.

The orange emission layer 23 preferably contains about 5 wt % to about 50 wt % t of tBuDPN as the auxiliary dopant. If the content of tBuDPN is less than about 5 wt %, it cannot satisfactorily function as the auxiliary dopant as described later. In the first embodiment, therefore, the content of tBuDPN is set to about 10 wt %. The tBuDPN as the auxiliary dopant is a naphtacene derivative, and has the function of transferring energy from NPB as the host material to DBzR as the luminescent dopant.

The NPB as the host material is an amine derivative. The NPB as the host material, DBzR as the luminescent dopant, and tBuDPN as the auxiliary dopant, which are contained in the orange emission layer 23, have respective molecular structures as shown in FIG. 3. It is to be noted that the orange emission layer 23 is an example of the "first emission layer" of the present invention, and the DBzR as the luminescent dopant is an example of the "first dopant material" of the invention. Also, the tBuDPN as the auxiliary dopant is an example of the "second dopant material" of the invention.

Figure 4:
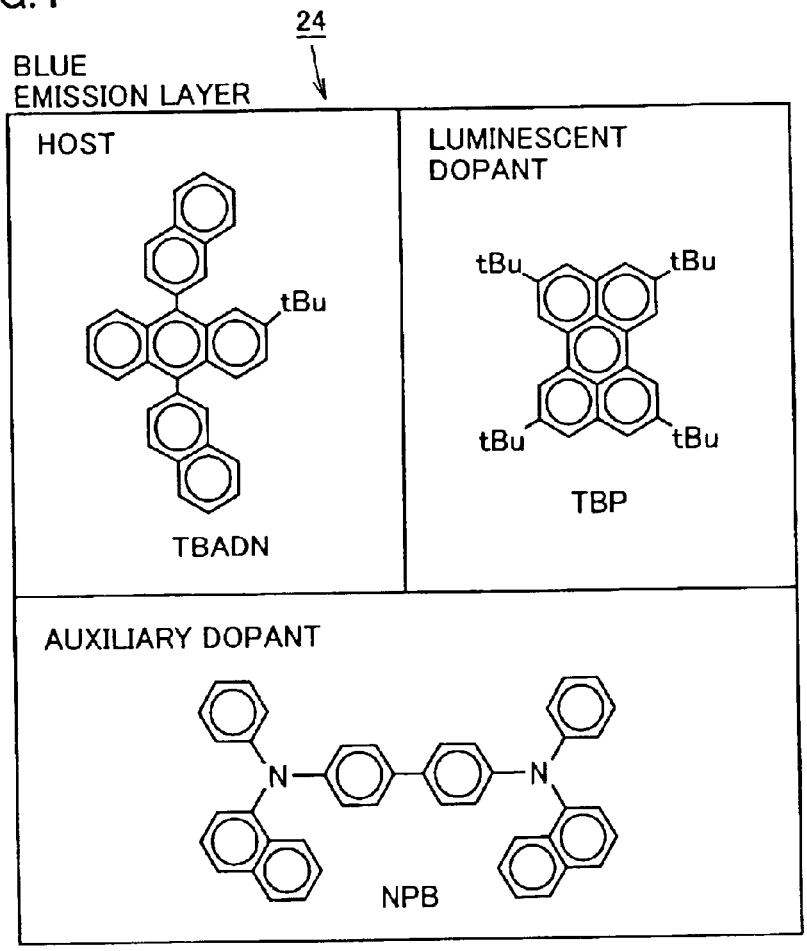
FIG. 4 is a view showing the molecular structures of a host material, a luminescent dopant and an auxiliary dopant, which are contained in a blue emission layer of the organic EL device according to the first embodiment shown in FIG. 2.

In the present embodiment, the blue emission layer 24 contains a host material which is TBADN (2-tert Butyl-9, 10-di(2-naphthyl) anthracene), a luminescent dopant which is TBP (1,4,7,10-Tetra-tert butyl perylene), and an auxiliary dopant which is NPB as shown in FIG. 4. The blue emission layer 24 preferably contains about 0.1 wt % to about 10 wt % of TBP as the luminescent dopant. If the content of TBP is less than about 0.1 wt %, effective luminescence cannot be produced. If the content of TBP exceeds about 10 wt %, on the other hand, the luminous intensity is reduced due to concentration quenching. In the first embodiment, therefore, the content of TBP is set to about 2 wt %. The TBP as the luminescent dopant is a perylene derivative, and has the function of emitting blue light. Thus, the blue emission layer 24, which contains TBP as the luminescent dopant, emits light having a wavelength of about 420 nm to about 550 nm.

The blue emission layer 24 preferably contains about 5 wt % to about 50 wt % of NPB as the auxiliary dopant. If the content of NPB is less than about 5 wt %, the NPB cannot satisfactorily function as the auxiliary dopant as described later. In the first embodiment, therefore, the content of NPB is set to about 10 wt %. The NPB as the auxiliary dopant is an amine derivative, and has the function of assisting in transportation of carriers (holes). The TBADN as the host material is an anthrancene derivative. The TBADN as the host material, TBP as the luminescent dopant, and NPB as the auxiliary dopant, which constitute the blue emission layer 24, have molecular structures as shown in FIG. 4.

It is to be noted that the blue emission layer 24 is an example of the "second emission layer" of the present invention, and the TBP as the luminescent dopant is an example of the "first dopant material" of the invention. Also, the NPB as the auxiliary dopant is an example of the "second dopant material" of the invention.

Figure 5:
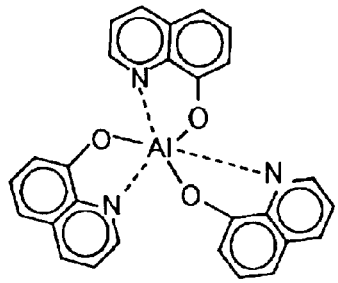
FIG. 5 is a view showing the molecular structure of Alq3 that forms an electron transport layer of the organic EL device according to the first embodiment shown in FIG. 2.
Figure 6:
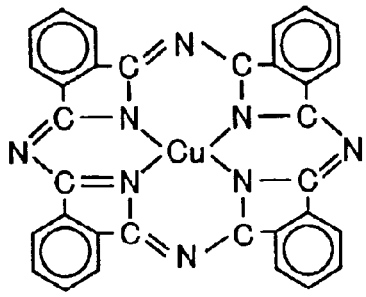
FIG. 6 is a view showing the molecular structure of CuPC that forms a hole injecting layer of the organic EL device according to the first embodiment shown in FIG. 2.

The electron transport layer 25 is formed of Alq3 (Tris (8-hydroxyquinolinato)aluminum), and has a thickness of about 10 nm. The Alq3 that forms the electron transport layer 25 has a molecular structure as shown in FIG. 5. The electron injecting layer 26 is formed of LiF and has a thickness of about 1 nm. The above-mentioned CuPC (Copper (II) phthalocyanine) that forms the hole injecting layer 21 has a molecular structure as shown in FIG. 6.

Figure 7:
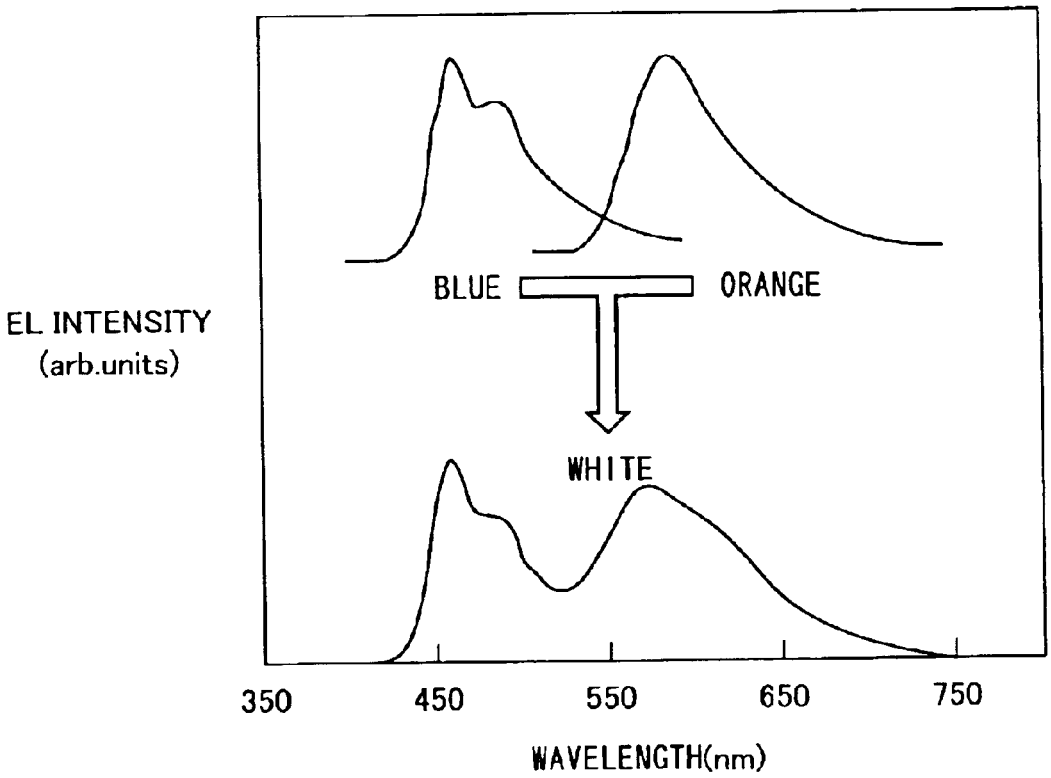
FIG. 7 is a characteristic diagram useful for explaining the color (white) of light emitted by the organic EL device shown in FIG. 1.

In the first embodiment, orange light emitted by the orange emission layer 23 and blue light emitted by the blue emission layer 24 are mixed together to produce a white emission, as shown in FIG. 7. The white light thus produced is emitted or radiated from the glass substrate 1 through the color filter (consisting of the red filter 9*a*, green filter 9*b* and the blue filter 9*c*).

In the first embodiment, the orange emission layer 23 contains tBuDPN as the auxiliary dopant that functions to transfer energy from NPB as the host material to DBzR as the luminescent dopant, as described above, so that the energy can be efficiently transferred from the NPB as the host material to the DBzR as the luminescent dopant. As a result, the luminous efficiency of the orange emission layer 23 can be improved. Also, the blue emission layer 24 contains NPB as the auxiliary dopant that functions to assist in transportation of holes, so that the probability of recombination of carriers (i.e., holes and electrons) can be increased. As a result, the luminous efficiency of the blue emission layer 24 can be improved. Thus, in the present embodiment, the luminous efficiencies of both of the orange emission layer 23 and the blue emission layer 24 can be improved, whereby the organic EL device is able to produce a white emission with a further improved luminous efficiency. With the luminous efficiency thus improved, there is no need to apply a large amount of electric current to the device. Consequently, otherwise possible deterioration of the device can be suppressed, and therefore the reliability (or lifetime) of the device can also be improved.

Figure 8:
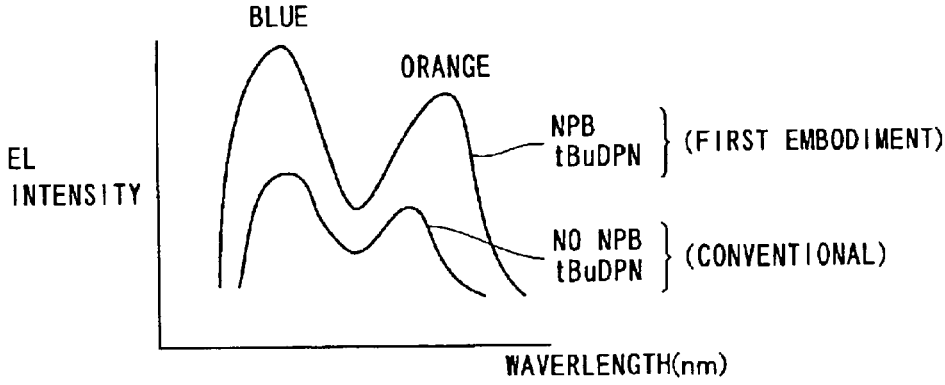
FIG. 8 is a characteristic diagram useful for explaining the effect of the organic EL device according to the first embodiment shown in FIG. 1.

FIG. 8 shows the EL intensity of the organic EL device according to the first embodiment in which the orange emission layer 23 contains tBuDPN as the auxiliary dopant and the blue emission layer 24 contains NPB as the auxiliary dopant, and the EL intensity of a conventional organic EL device containing no auxiliary dopants. It will be understood from FIG. 8 that the EL intensity in a frequency region corresponding to blue right and the EL intensity in a frequency region corresponding to orange light are both higher in the device of the first embodiment than those of the conventional device. Actual measurements of the luminous efficiency conducted by the inventors of the present invention indicated that the luminous efficiency of the conventional organic EL device was 7 to 8 cd/A, whereas the luminous efficiency of the organic EL device according to the first embodiment was about 10 to 15 cd/A.

In the first embodiment, the orange emission layer 23 is disposed on the hole transport layer 22 that is located on one side of the emission layers 23, 24 closer to the light-emitting surface (the lower surface in FIG. 1) of the organic EL device, so that the luminous efficiency can be further improved. More specifically, if the blue emission layer 24 is directly disposed on the hole transport layer 22 formed of NPB, electrons that enter the blue emission layer 24 have some difficulty in entering the hole transport layer 22 formed of NPB having a low electron mobility, and therefore the electrons tend to accumulate on the lower surface of the blue emission layer 24. In this case, further injection of electrons into the blue emission layer 24 is impeded or disturbed, resulting in reductions in the luminous efficiency and the lifetime. On the other hand, if the orange emission layer 23 is disposed between the blue emission layer 24 and the hole transport layer 22 formed of NPB, as in the first embodiment, the electrons in the blue emission layer 24 are more likely to enter the orange emission layer 23 due to the presence of tBuDPN as the auxiliary dopant in the orange emission layer 23. With this arrangement, accumulation of the electrons on the lower surface of the blue emission layer 24 can be suppressed or avoided, and therefore the luminous efficiency of the blue emission layer 24 can be prevented from being reduced. Consequently, the luminous efficiency and the lifetime of the organic EL device can be improved.

Owing to the improvement of the luminous efficiency in the first embodiment as described above, the organic EL device that uses the TFTs and the color filter (consisting of the red filter 9*a*, green filter 9*b* and the blue filter 9*c*) as shown in FIG. 1 is able to produce excellent luminescence, in spite of an optical loss due to a reduction in the opening ratio caused by the TFTs and an optical loss due to the color filter. It is thus possible to provide an active drive type, full-color organic EL display having improved luminous efficiency and improved reliability (or device lifetime).

SECOND EMBODIMENT

Figure 9:
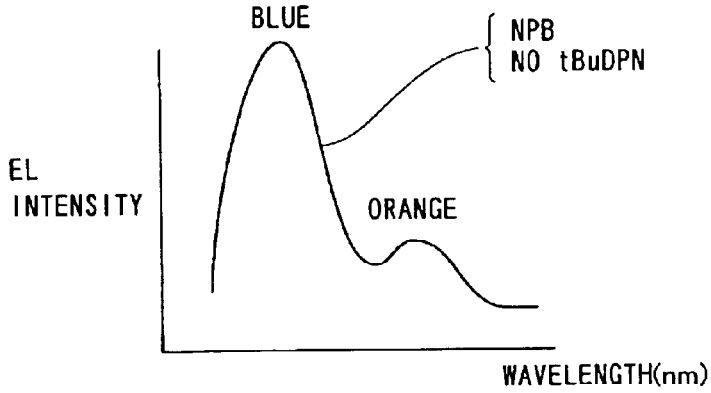
FIG. 9 is a characteristic diagram useful for explaining the effect of an organic EL device according to a second embodiment of the invention.

A second embodiment of the present invention is provided by modifying the first embodiment such that only the blue emission layer 24 contains NPB as an auxiliary having the function of assisting in transportation of holes, and the orange emission layer 23 does not contain tBuDPN as an auxiliary dopant. Referring to FIG. 9, in the second embodiment, the EL intensity is increased only in a frequency region corresponding to blue light, and the EL intensity in a frequency region corresponding to orange light is at substantially the same level as that of the conventional device (as shown in FIG. 8). In this case, too, the luminous efficiency of the blue emission layer 24 can be improved, and therefore the luminous efficiency in producing a white emission can be improved as compared with that of the conventional device, by an amount corresponding to the improvement of the luminous efficiency of the blue emission layer 24. With the luminous efficiency thus improved, the reliability (or lifetime) of the device can be improved.

THIRD EMBODIMENT

Figure 10:
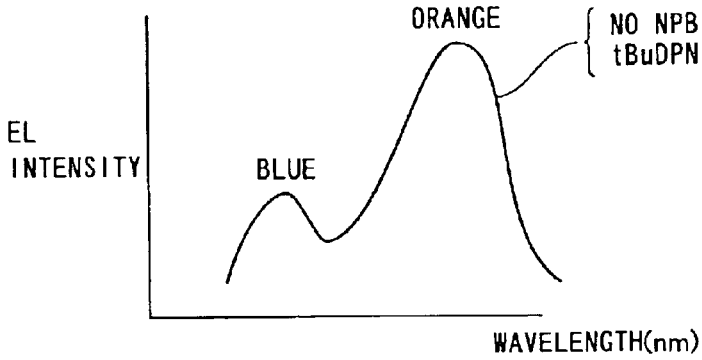
FIG. 10 is a characteristic diagram useful for explaining the effect of an organic EL device according to a third embodiment of the invention.
Figure 11:
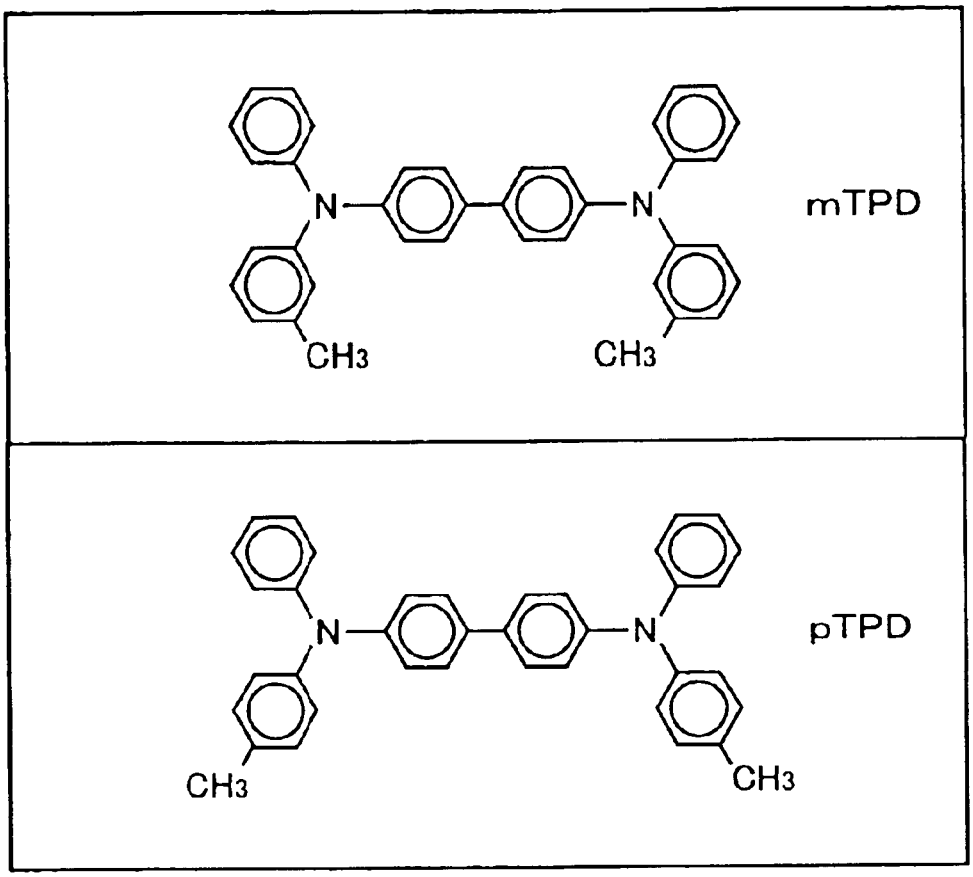
FIG. 11 is a view showing the molecular structures of other examples of a host material contained in an orange emission layer.

A third embodiment of the present invention is provided by modifying the first embodiment such that only the orange emission layer 23 contains tBuDPN as an auxiliary dopant that functions to transfer energy from the host material to the luminescent dopant material, and the blue emission layer 24 does not contain NPB as an auxiliary dopant. Referring to FIG. 10, in the third embodiment, the EL intensity is increased only in a frequency region corresponding to orange light, and the EL intensity in a frequency region corresponding to blue light is at substantially the same level as that of the conventional device (as shown in FIG. 8). In this case, too, the luminous efficiency of the orange emission layer 23 can be improved, and therefore the luminous efficiency in producing a white emission can be improved as compared with that of the conventional device, by an amount corresponding to the improvement of the luminous efficiency of the orange emission layer 23. With the luminous efficiency thus improved, the reliability (or lifetime) of the device can be improved.

It is to be understood that the illustrated embodiments are merely exemplary, and the present invention is not limited to details of the illustrated embodiments. The scope of the invention is not defined by the above description of the embodiments, but defined by the appended claims. It is also to be understood that the invention may be embodied with various changes, modifications, or improvements, without departing from the scope of the invention as defined in the appended claims, and equivalents thereof.

While one host material is doped with one luminescent dopant and one auxiliary dopant in the illustrated embodiments, the present invention is not limited to this arrangement, but the host material may contain two or more auxiliary dopants. In the case where the host material contains two or more auxiliary dopants, it preferably contains both an auxiliary dopant that assists in transfer of energy, and an auxiliary dopant that assists in transportation of carriers. In another example, two host materials may contain a plurality of dopants.

While the illustrated embodiments are concerned with active drive type full-color organic EL devices, the present invention is not limited to this application, but may be applied to non-full-color organic EL devices capable of emitting white light. The invention is also applicable to light-emitting devices other than organic EL devices.

While tBuDPN is used as the auxiliary dopant that transfers energy from the host material to the luminescent dopant material in the illustrated embodiments, the present invention is not limited to the use of tBuDPN for this purpose. Rather, the auxiliary dopant may be selected from other dopant materials, such as rubrene derivatives, provided that the selected dopant has the function of transferring energy from the host material to the luminescent dopant.

While NPB is used as the auxiliary dopant that assists in transportation of carriers in the illustrated embodiments, the present invention is not limited to the use of NPB for this purpose, but other auxiliary dopants having the function of assisting in transportation of carriers may be used.

While NPB as an amine derivative is used as the host material of the orange emission layer in the illustrated embodiments, the present invention is not limited to the use of NPB, but the host material may be selected from other amine derivatives than NPB. For example, an amine derivative, such as mTPD (N,N'-(3-methylphenyl)-1,1'-biphenyl-4,4'-diamine) or pTPD (N,N'-(4-methylphenyl)-1,1'-biphenyl-4,4'-diamine) may be used as the host material of the orange emission layer.

What is claimed is:

1. A light-emitting device comprising:

a first emission layer formed on a substrate; and a second emission layer formed on said first emission layer to provide a laminated structure, said second emission layer emitting light having a different wavelength from that of light emitted by said first emission layer, wherein at least one of said first emission layer and said second emission layer comprises a host material, a luminescent first dopant material, and a non-luminescent second dopant material.

2. The light-emitting device according to claim 1, wherein said non-luminescent second dopant material has at least one of a function of assisting in transportation of carriers and a function of transferring energy from said host material to said luminescent first dopant material.

3. The light-emitting device according to claim 2, wherein said non-luminescent second dopant material comprises a naphthacene derivative having the function of transferring energy from said host material to said luminescent first dopant material.

4. The light-emitting device according to claim 3, wherein said non-luminescent second dopant material consisting of said naphtacene derivative is tBuDPN.

5. The light-emitting device according to claim 4, wherein said second dopant material consisting of said tBuDPN is contained in at least one of said first emission layer and said second emission layer in an amount that is equal to or greater than 5% by weight and is less than 50% by weight.

6. The light-emitting device according to claim 2, wherein said non-luminescent second dopant material comprises a rubrene derivative having the function of transferring energy from said host material to said luminescent first dopant material.

7. The light-emitting device according to claim 2, wherein said non-luminescent second dopant material comprises an amine derivative having the function of assisting in transportation of said carriers.

8. The light-emitting device according to claim 7, wherein said non-luminescent second dopant material consisting of said amine derivative is NPB.

9. The light-emitting device according to claim 8, wherein said non-luminescent second dopant material consisting of said NPB is contained in at least one of said first emission layer and said second emission layer in an amount that is equal to or greater than 5% by weight and is less than 50% by weight.

10. The light-emitting device according to claim 1, wherein each of said first emission layer and said second emission layer comprises said host material, said luminescent first dopant material, and said non-luminescent second dopant material.

11. The light-emitting device according to claim 1, wherein:

said first emission layer comprises an orange emission layer containing said second dopant material having a function of transferring energy from said host material to said luminescent first dopant material; and said second emission layer comprises a blue emission layer containing said second dopant material having a function of assisting in transportation of carriers.

12. The light-emitting device according to claim 11, wherein said orange emission layer-comprises:

the host material consisting of an amine derivative;

the luminescent first dopant material consisting of a naphthacene derivative; and the non-luminescent second dopant material consisting of a naphthacene derivative and having the function of transferring energy from said host material to said luminescent first dopant material.

13. The light-emitting device according to claim 12, wherein said orange emission layer comprises:

the host material consisting of NPB;

the luminescent first dopant material consisting of DBzR; and the second dopant material consisting of tBuDPN.

14. The light-emitting device according to claim 11, wherein said blue emission layer comprises:

the host material consisting of an anthracene derivative;

the luminescent first dopant material consisting of a perylene derivative; and the non-luminescent second dopant material consisting of an amine derivative and having the function of assisting in transportation of the carriers.

15. The light-emitting device according to claim 14, wherein said blue emission layer comprises:

the host material consisting of TBADN;

the luminescent first dopant material consisting of TBP; and the non-luminescent second dopant material consisting of NPB.

16. The light-emitting device according to claim 1, wherein:

said first emission layer comprises an orange emission layer disposed on the side of a light-emitting surface of the light-emitting device; and said second emission layer comprises a blue emission layer disposed on the side opposite to the light-emitting surface.

17. The light-emitting device according to claim 1, further comprising:

a thin-film transistor formed on said substrate for each pixel; and a color filter disposed above a region in which said thin-film transistor is not formed and disposed below said first emission layer and said second emission layer.

18. The light-emitting device according to claim 1, wherein said first emission layer comprises an orange emission layer containing said second dopant material having a function of transferring energy from said host material to said luminescent first dopant material.

19. The light-emitting device according to claim 1, wherein said second emission layer comprises a blue emission layer containing said second dopant material having a function of assisting in transportation of carriers.

20. The light-emitting device according to claim 2, wherein:

said non-luminescent second dopant material comprises at least two said second dopants; and said at least two second dopants comprise a dopant that assists in transportation of carriers, and a dopant that transfers energy from said host material to said luminescent first dopant material.

* * * * *